US006419468B1

(12) United States Patent
Kemp

(10) Patent No.: US 6,419,468 B1
(45) Date of Patent: Jul. 16, 2002

(54) RECIPROCATING SIPHON SUCTION PUMP

(76) Inventor: John M. Kemp, 4511 Lucksinger La. #20, Austin, TX (US) 78945

( * ) Notice: Subject to any disclaimer, the term of this patent is extended or adjusted under 35 U.S.C. 154(b) by 0 days.

(21) Appl. No.: 10/047,391

(22) Filed: Jan. 15, 2002

(51) Int. Cl.[7] ..... F04B 39/10; F04B 53/12; F04F 10/00; F16L 43/00

(52) U.S. Cl. ..... 417/547; 417/555.1; 137/146; 137/151

(58) Field of Search ..... 417/547, 555.1; 137/146, 147, 151

(56) References Cited

U.S. PATENT DOCUMENTS 1,915,403 A * 6/1933 Clark ..... 137/146
2,233,123 A * 2/1941 Fritts ..... 137/147
4,290,443 A * 9/1981 Crozzoli ..... 137/147
4,762,474 A * 8/1988 Dartnall ..... 417/469
4,989,760 A * 2/1991 Songzeng ..... 137/151

* cited by examiner

*Primary Examiner*—Charles G. Freay
*Assistant Examiner*—Timothy P. Solak

(57) ABSTRACT

A container includes an integral outlet tube that functions as a cylinder. A siphon mechanism including an elongated tube with a flexible seal on the outside surface of the tube functions as a piston. Fluid trapped inside the cylinder by a check valve is forced up and over the side of the container by downward movement of the piston inside the cylinder initiating the siphoning of further fluid from inside the container.

9 Claims, 1 Drawing Sheet

RECIPROCATING SIPHON SUCTION PUMP

FIELD OF THE INVENTION

A common reciprocating suction pump has been redesigned to be used for the purpose of initiating siphoning action involved in the draining of water from reservoirs of planters and liquids in other containers.

BACKGROUND OF THE INVENTION

Heretofore it has been necessary to initiate a siphoning action by means of a separate suction device to draw water to the distal end of a siphon tube. Siringes and squeeze bulbs of various sizes and shapes have been utilized. There have been no siphon tubes which activate automatically when inserted within a container containing fluid.

OBJECTS AND ADVANTAGES

The present invention makes it possible to combine the advantages of a common reciprocating suction pump with the advantages of siphoning. Automatic siphoning action is created by adding the components of a common reciprocating suction pump. Such components become an integral part of the planter (or other container) and the siphon tube. When a planter is to be drained and the siphon tube is inserted into the outlet tube, instant siphoning action is initiated. Upward movement of the siphon tube is necessary only when there is a small amount of water within the reservoir; consequently, under normal draining procedures, only the downward insertion is necessary.

The components include a cylinder, a piston, and 2 valves. The outlet tube of the planter serves as a cylinder. A piston is attached to the proximal end of the siphon tube. A valve is installed in the outlet tube and a valve is installed in the siphon tube.

DRAWING REFERENCE NUMERALS

Figure 1:
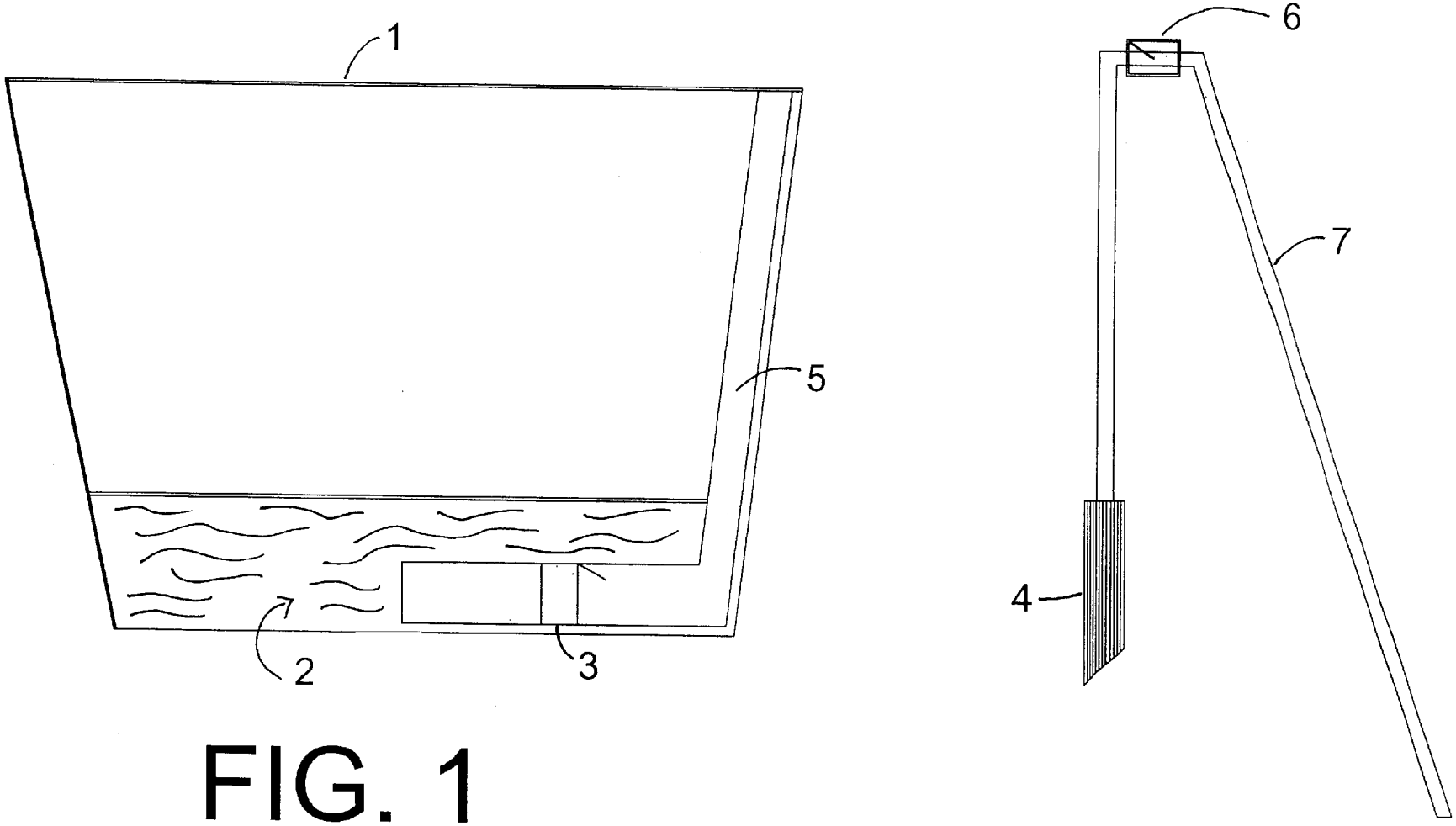
FIG. 1. A standard planter with an outlet tube and valve installed. Also a siphon tube with a piston and a valve.

1. Planter
2. Water Reservoir
3. Outlet Valve
4. Piston
5. Outlet Tube
6. Siphon Tube Valve
7. Siphon Tube

OPERATION OF INVENTION

When the siphon tube piston (4) is inserted into the water reservoir outlet tube (5), the downward movement of the siphon tube piston (4) forces closure of the outlet tube valve (3). This results in water being forced upwards into the siphon tube (7) and the siphon tube valve (6) opens. As the downward movement continues, water is forced through the siphon tube (7) over the top edge of the planter (1) and the siphoning action is initiated. This reverse pressure instantly opens the outlet tube valve (3), resulting in continued siphoning action.

When the siphon tube (7) is pulled upwards the outlet tube valve (3) opens and the siphon tube valve (6) closes shutting off the air intake from the distal end of the siphon tube (7). This results in water being trapped in the outlet tube (5). This water can then be forced into the siphon tube (7) when the siphon tube piston (4) is pushed downward.

It is important to mention the fact that if a piston is constructed of such material as thin flexible plastic or rubber, the piston will fit very snugly and effectively. Consequently, there would be virtually no suction by-pass within the outlet tube. This makes it possible to eliminate the horizontal section of the outlet tube and place the outlet tube valve in the lower section of the perpendicular part of the outlet tube. The piston then stops at a point above the outlet tube valve. In this arrangement (no drawings shown) the siphon tube continues to draw water from the reservoir when the water level is below the proximal end of the siphon tube.

I claim:

1. A device for initiating siphoning action to remove fluid from a fluid reservoir, comprising:

a reservoir containing a fluid having at least a bottom section and side sections;

an outlet tube connected to a fluid side of said reservoir and having an open first end and an open second end, said first open end located in a position to take suction from said bottom section of said reservoir; and an inlet check valve located inside said outlet tube adjacent said first open end, such that fluid can flow from said reservoir into said outlet tube;

a siphon mechanism comprising a hollow tube with a suction portion having a length greater than a distance between said bottom section and a top extent of said side sections of said reservoir, a middle portion and a discharge portion having a length greater than said suction portion; and a discharge check valve located in said siphon mechanism, such that fluid can flow from the suction portion towards the discharge portion; and a flexible piston, attached to an outside surface of said siphon mechanism positioned at one end of said suction portion opposite said middle section;

wherein an airtight seal is formed between the outlet tube and siphon mechanism when said suction potion of the siphon mechanism is inserted into said second open end of said outlet tube and further downward movement of the siphon mechanism initiates a siphoning action to draw fluid from said reservoir up the suction portion, through the middle portion and down said discharge portion expelling said fluid from the reservoir.

2. The device for initiating siphoning action according to claim 1 wherein said reservoir is a planter.

3. The device for initiating siphoning action according to claim 1 wherein said discharge check valve is located in said suction portion of said siphon mechanism.

4. The device for initiating siphoning action according to claim 1 wherein said discharge check valve is located in said middle portion of said siphon mechanism.

5. The device for initiating siphoning action according to claim 1 wherein said discharge check valve is located in said discharge portion of said siphon mechanism.

6. The device for initiating siphoning action according to claim 1 wherein said outlet tube further comprises:

a first portion containing said first open end and connected to and extending parallel to said bottom section of said reservoir, and a second portion containing said second open end and extending at an angle to said first portion and connected to said side section of said reservoir.

7. A method for siphoning fluid from a container having at least a bottom section and side sections; and equipped with an outlet tube connected to a fluid side of said container and having an open first end and an open second end, said first open end located in a position to take suction from said bottom section of said container; and an inlet check valve located inside said outlet tube adjacent said first open end, such that fluid can flow from said reservoir into said outlet tube comprising the steps;

providing a siphon mechanism comprising a hollow tube with a suction portion having a length greater than a distance between said bottom section and a top extent of said side sections, a middle portion and a discharge portion having a length greater than said suction portion; and a discharge check valve located in said siphon mechanism, such that fluid can flow from the suction portion towards the discharge portion; and a flexible piston, attached to an outside surface of said siphon mechanism positioned at one end of said suction portion opposite said middle section;

inserting said flexible piston into said open second end of outlet tube; moving siphon mechanism downward.

8. A method for siphoning fluid from a container as defined in claim 7 further comprising the steps:

moving said siphon mechanism upwards until a top portion of said piston aligns with said open second end of outlet tube;

moving siphon mechanism downward.

9. A method for siphoning fluid from a container as defined in claim 7 wherein said container is a planter.

* * * * *